US008093819B2

(12) United States Patent
Tsai

(10) Patent No.: US 8,093,819 B2
(45) Date of Patent: Jan. 10, 2012

(54) FLASHING LIGHT STRING

(75) Inventor: Luan Tsai, Hsinchu (TW)

(73) Assignee: Jiangmen Polestar Electric Industries Co., Ltd., Jiangmen, Guangdong (CN)

( * ) Notice: Subject to any disclaimer, the term of this patent is extended or adjusted under 35 U.S.C. 154(b) by 488 days.

(21) Appl. No.: 12/382,703

(22) Filed: Mar. 23, 2009

(65) Prior Publication Data

US 2010/0237788 A1 Sep. 23, 2010

(51) Int. Cl.
*H05B 37/00* (2006.01)

(52) U.S. Cl. ..... 315/185 R; 315/188; 315/185 S; 315/192; 315/323; 362/227; 362/800; 362/806

(58) Field of Classification Search ..... 315/185 R, 315/185 S, 188, 192, 312, 200 A, 323; 362/122, 362/123, 227, 800, 806; 340/815.45, 954, 340/956; 250/552, 553
See application file for complete search history.

(56) References Cited

U.S. PATENT DOCUMENTS

| | | | | |
|---|---|---|---|---|
| 5,128,595 | A * | 7/1992 | Hara | 315/312 |
| 6,285,140 | B1 * | 9/2001 | Ruxton | 315/312 |
| 6,344,716 | B1 * | 2/2002 | Gibboney, Jr. | 315/185 S |
| 7,067,992 | B2 * | 6/2006 | Leong et al. | 315/291 |
| 7,270,450 | B2 * | 9/2007 | Chan | 362/398 |
| 7,629,601 | B2 * | 12/2009 | Glassner et al. | 250/552 |

* cited by examiner

*Primary Examiner* — Haiss Philogene
(74) *Attorney, Agent, or Firm* — Bacon & Thomas, PLLC

(57) ABSTRACT

A light string includes a load comprising a trigger LED assembly and a lighting assembly connected in series with the trigger LED assembly, the lighting assembly comprising a plurality of series connected lamps comprising an LED; and a rectifier for converting a source of AC into DC which is supplied to the load. The trigger LED assembly is adapted to flash and cause the lamps to flash. In one embodiment the trigger LED assembly includes a trigger LED and a capacitor connected in parallel with the trigger LED. The trigger LED includes a first LED and a second LED. The cathode of the first LED is connected to the cathode of the second LED, the anode of the first LED is connected to the positive terminal of the capacitor, and the anode of the second LED is connected to the negative terminal of the capacitor respectively.

8 Claims, 5 Drawing Sheets

FLASHING LIGHT STRING

BACKGROUND OF THE INVENTION

1. Field of Invention

The invention relates to providing electrical power to a plurality of low voltage electrical loads, and more particularly to a string of lights including one or more flashing devices and a plurality of lamps (e.g., LED (light emitting diode) lamps) connected in series therewith.

2. Description of Related Art

LEDs (light emitting diodes) are renowned for their long life and their ability to resist shock. Also, an LED consumes much less electrical power than fluorescent lamps (i.e., energy saving). Therefore, LED lighting devices are gaining popularity worldwide.

A typical flashing string of lights includes a flashing control member formed of IC (integrated circuit) (the flashing control member hence hereinafter called IC throughout the specification) and a plurality of (e.g., 40) blue LED bulbs arranged electrically in a series circuit is shown in FIG. 1. AC (alternating current) 120V is rectified and converted by a full-wave rectifier (e.g., bridge rectifier (not shown) in the IC) into DC (direct current) to be consumed by the plurality of blue LED bulbs and the IC. Moreover, the IC is adapted to control the flashing of the LED bulbs.

However, the well known flashing light string suffers from a number of disadvantages including high production cost, the IC being low in performance, and complicated manufacturing processes.

There have been numerous suggestions in prior patents for light string. For example, U.S. Pat. No. 6,344,716 discloses a Christmas light string. Thus, continuing improvements in the exploitation of light string are constantly being sought.

SUMMARY OF THE INVENTION

It is therefore one object of the invention to provide a flashing light string having a trigger LED assembly and a plurality of lamps (e.g., LED lamps) connected in series therewith in which each of the trigger LED assembly and the lamps is adapted to flash.

The above and other objects, features and advantages of the invention will become apparent from the following detailed description taken with the accompanying drawings.

DETAILED DESCRIPTION OF THE INVENTION

Figure 1:
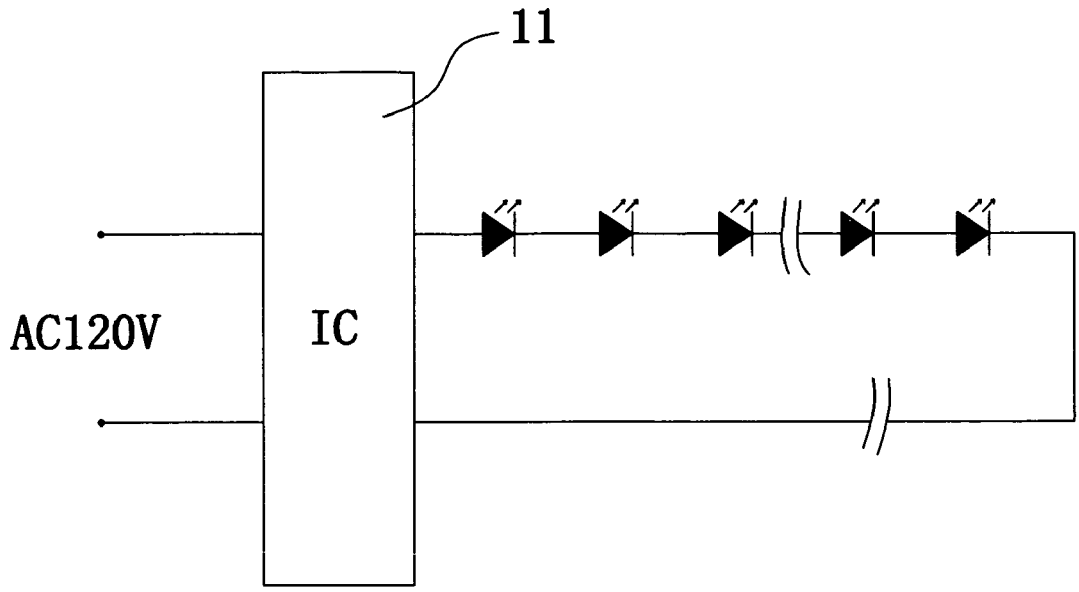
Fig. 1 PRIOR ART
FIG. 1 is a circuit diagram of a typical flashing LED light string with lamps arranged in series.
Figure 2:
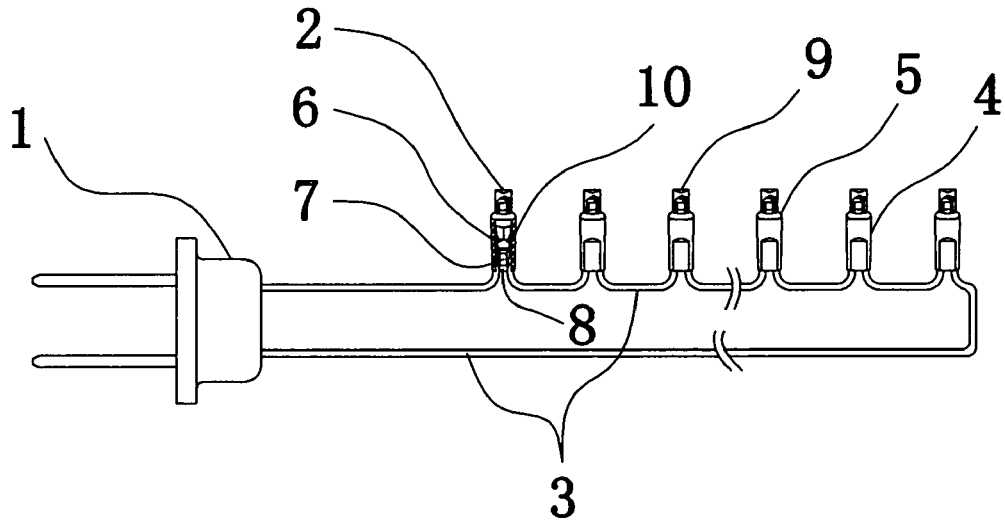
FIG. 2 is an illustration of a string of flashing lights according to the invention.
Figure 3:
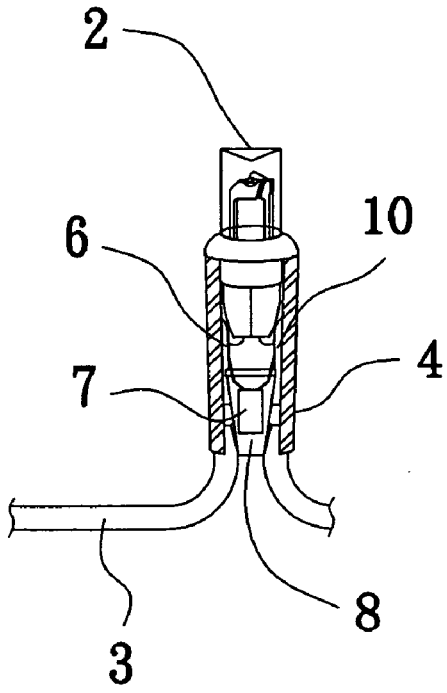
FIG. 3 is an enlarged view of the lamp of FIG. 2.

Referring to FIGS. 2 and 3, a string of flashing lights in accordance with the invention is shown. The light string comprises a plug 1 having positive and negative prongs (not numbered) and a rectifier (e.g., bridge rectifier (not shown)) adapted to convert AC source (e.g., AC 120V) into DC 120V (i.e., operating voltage) to be consumed by a load (i.e., lamps) as detailed below.

The load of the light string is comprised of lamps 4 connected in series and a cord 3 connecting the positive terminal of the rectifier, the lamps 4, and the negative terminal of the rectifier together.

The lamp 4 connecting the positive terminal of the rectifier is implemented as a trigger LED assembly including a seat 8, a first contact 6 connected to one end of a section of the cord 3, a second contact 10 connected to one end of another section of the cord 3, a capacitor 7 secured onto the seat 8 and interconnecting the contacts 6 and 10, a top cap 5, and an exposed trigger LED 2 secured onto the cap 5 and also interconnecting the contacts 6 and 10.

Each of the remaining lamps 4 is implemented as an LED assembly including a first contact 6 connected to one end of a section of the cord 3, a second contact 10 connected to one end of another section of the cord 3, a seat 8, a top cap 5, and an exposed LED 9 secured onto the cap 5 and interconnecting the contacts 6 and 10.

A plurality of preferred embodiments of the flashing light string according to the invention are described in detail below.

Figure 4:
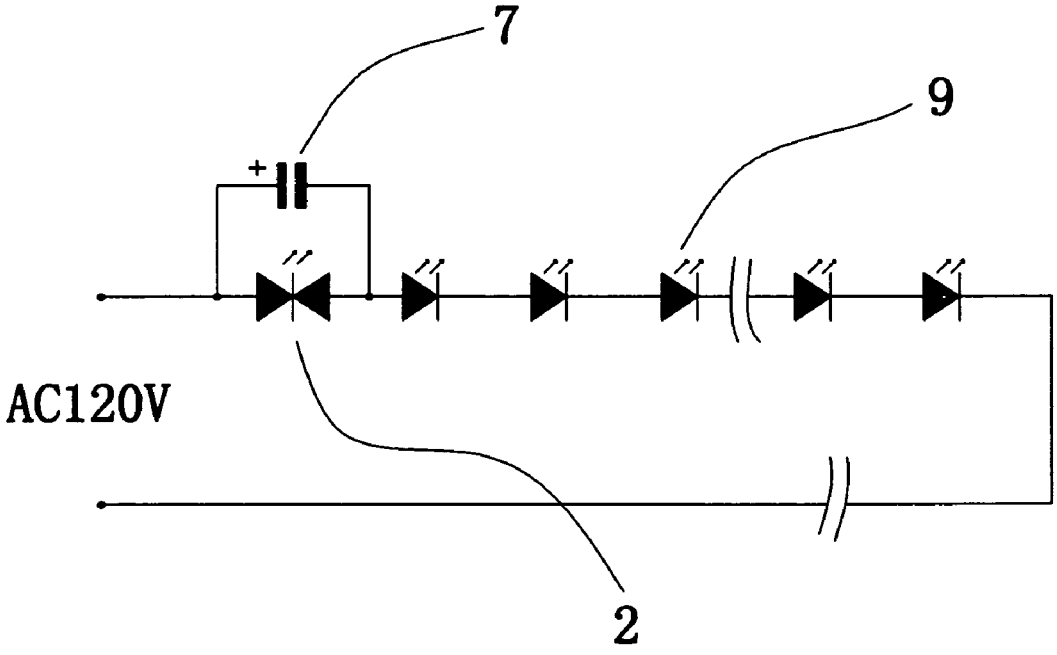
FIGS. 4, 5, 6, 7, 8, 9 and 10 are circuit diagrams of first, second, third, fourth, fifth, sixth and seventh preferred embodiments of flashing light string according to the invention respectively.

Referring to FIG. 4, a circuit diagram of a first preferred embodiment of flashing light string according to the invention is shown. The load of the flashing light string comprises a trigger LED assembly including a trigger LED 2 and a capacitor 7 connected in parallel with the trigger LED 2 (i.e., the voltage of the capacitor 7 is the same as that of the trigger LED 2); and a plurality of lamps connected in series with the trigger LED assembly, the lamp being implemented as an LED 9. The trigger LED 2 is comprised of a first LED and a second LED in which the cathode of the first LED is connected to the cathode of the second LED, the anode of the first LED is connected to the positive terminal of the capacitor 7, and the anode of the second LED is connected to the negative terminal of the capacitor 7 respectively.

The operating voltage and operating current of the trigger LED 2 is 3 VDC and 0.02 A respectively. Also, the operating voltage and operating current of the LED 9 is 3 VDC and 0.02 A respectively. The number of the LEDs 9 is 39.

In operation, the capacitor 7 stores electrical energy initially, i.e., the trigger LED 2 and the LEDs 9 are disabled. The capacitor 7 may discharge when a breakdown voltage thereof is built. The trigger LED 2 is thus triggered (i.e., lit) when this occurs. Also, the LEDs 9 are lit (i.e., emitting light). The trigger LED 2 and the LEDs 9 are disabled again when the voltage of the capacitor 7 becomes less than the breakdown voltage thereof due to the discharge. A flashing effect is thus occurred since the above charging and discharging occur sequentially in a short period of time and repeats as long as the light string is activated.

Figure 5:
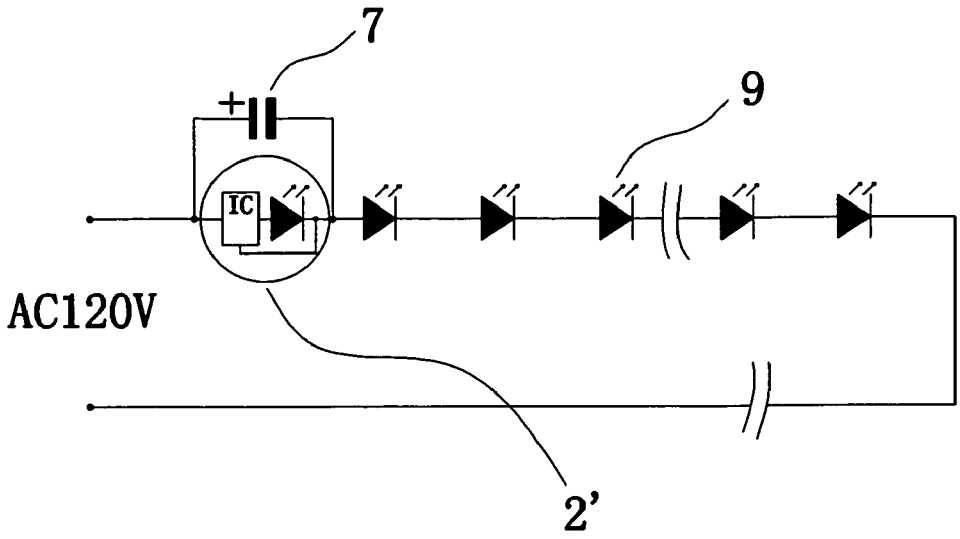

Referring to FIG. 5, a circuit diagram of a second preferred embodiment of flashing light string according to the invention is shown. The characteristics of the second preferred embodiment (i.e., the trigger LED assembly) are detailed below. The trigger LED assembly comprises a flashing trigger LED 2' and a capacitor 7 connected in parallel with the trigger LED 2' (i.e., the voltage of the capacitor 7 is the same as that of the trigger LED 2'). The trigger LED 2' is comprised of a first LED and a series connected IC in which a first terminal of the IC is connected to the positive terminal of the capacitor 7, a second terminal thereof is connected to the anode of the first LED, and a third terminal thereof is connected to both the cathode of the first LED and the negative terminal of the capacitor 7. The operating voltage and operating current of the flashing trigger LED 2' is 4 VDC and 0.02 A respectively. Also, the flashing trigger LED 2' is adapted to emit only light rays of a single color by flashing.

In operation, the capacitor 7 stores electrical energy initially, i.e., the trigger LED 2' and the LEDs 9 are disabled. The capacitor 7 may discharge when a breakdown voltage thereof is built. The trigger LED 2' is thus triggered (i.e., lit) when this occurs. Also, the LEDs 9 are lit (i.e., emitting light). The trigger LED 2 and the LEDs 9 are disabled again when the voltage of the capacitor 7 becomes less than the breakdown voltage thereof. A flashing effect is thus occurred since the above charging and discharging occur sequentially in a short period of time and repeats as long as the light string is activated. Note that the provision of the IC in the trigger LED 2' can enhance the flashing performance of the light string.

Figure 6:
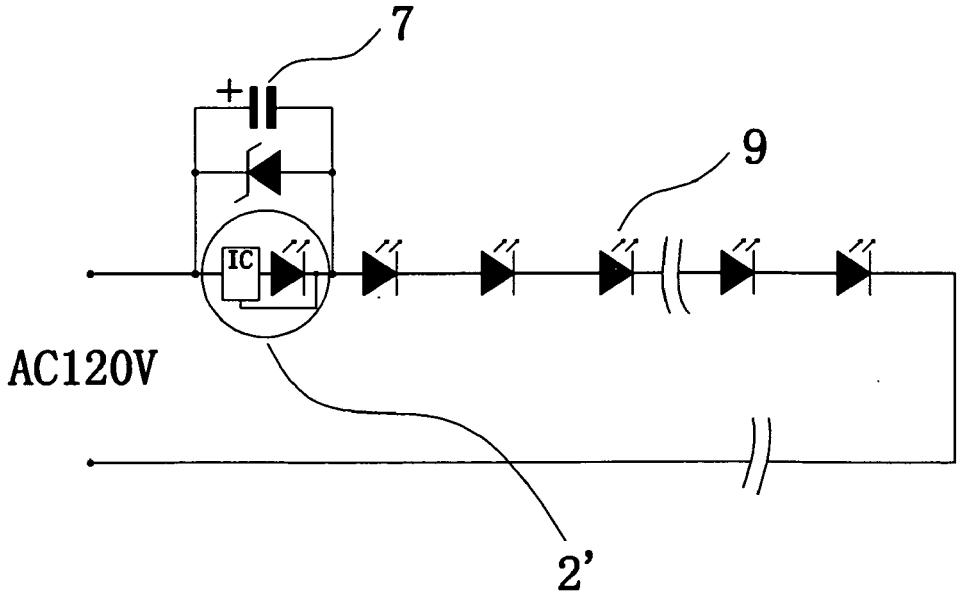

Referring to FIG. 6, a circuit diagram of a third preferred embodiment of flashing light string according to the invention is shown. The characteristics of the third preferred embodiment (i.e., the trigger LED assembly) are detailed below. The trigger LED assembly comprises a flashing trigger LED 2', a capacitor 7 connected in parallel with the trigger LED 2', and a Zener diode (not numbered) also 7 connected in parallel with the trigger LED 2' (i.e., the voltage of the capacitor 7 is the same as that of each of the trigger LED 2' and the Zener diode). The trigger LED 2' is comprised of a first LED and a series connected IC in which a first terminal of the IC is connected to both the positive terminal of the capacitor 7 and the cathode of the Zener diode, a second terminal thereof is connected to the anode of the first LED, and a third terminal thereof is connected to the cathode of the first LED, the anode of the Zener diode, and the negative terminal of the capacitor 7 respectively. The operating voltage and operating current of the flashing trigger LED 2' is 4 VDC and 0.02 A respectively. The flashing trigger LED 2' is adapted to emit light rays of two different colors by flashing. Also, the operating voltage and operating current of the LED 9 is 2 VDC and 0.02 A respectively. The number of the LEDs 9 is 58.

In operation, the capacitor 7 stores electrical energy initially, i.e., the trigger LED 2' and the LEDs 9 are disabled. The capacitor 7 may discharge when a breakdown voltage thereof is built. The trigger LED 2' is thus triggered (i.e., lit) when this occurs. Also, the LEDs 9 are lit (i.e., emitting light). The trigger LED' 2 and the LEDs 9 are disabled again when the voltage of the capacitor 7 becomes less than the breakdown voltage thereof. A flashing effect is thus occurred since the above charging and discharging occur sequentially in a short period of time and repeats as long as the light string is activated. Note that the provision of the IC in the trigger LED 2' can enhance the flashing performance of the light string. Also, the provision of the Zener diode aims at stabilizing the voltage of the first LED of the trigger LED 2'.

Figure 7:
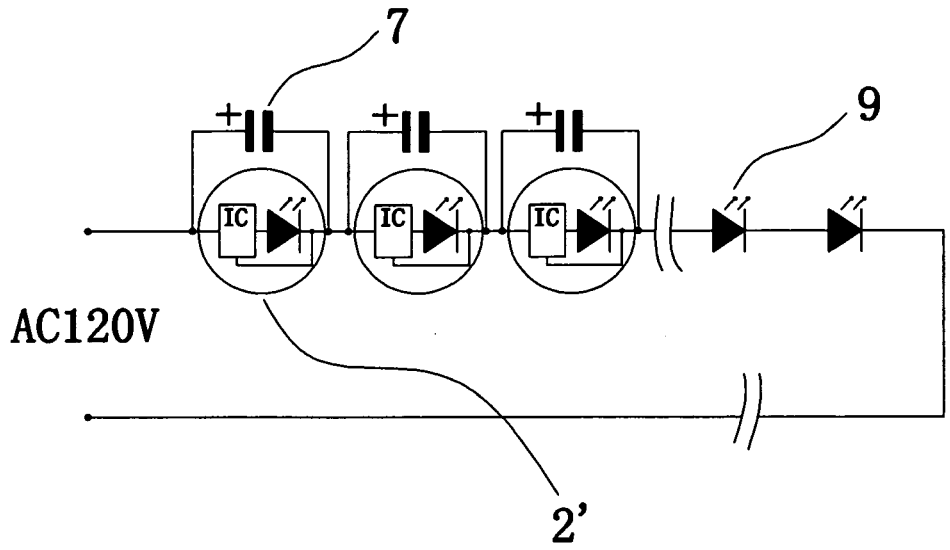

Referring to FIG. 7, a circuit diagram of a fourth preferred embodiment of flashing light string according to the invention is shown. The characteristics of the fourth preferred embodiment (i.e., the trigger LED assembly) are detailed below. The trigger LED assembly comprises a plurality of flashing trigger LEDs 2' having a capacitor 7 connected in parallel therewith (i.e., the voltage of the capacitor 7 is the same as that of the trigger LED 2' of the same set). The trigger LED 2' is comprised of a first LED and a series connected IC in which a first terminal of the IC is connected to the positive terminal of the capacitor 7, a second terminal thereof is connected to the anode of the first LED, and a third terminal thereof is connected to both the cathode of the first LED and the negative terminal of the capacitor 7. The operating voltage and operating current of the flashing trigger LED 2' is 3 VDC and 0.02 A respectively. The flashing trigger LED 2' is adapted to emit light rays of two different colors by flashing. The number of the LEDs 9 is 20.

in operation, for each set of flashing trigger LED 2' the capacitor 7 stores electrical energy initially, i.e., the trigger LED 2' and the LEDs 9 are disabled. The capacitor 7 may discharge when a breakdown voltage thereof is built. The trigger LED 2' is thus triggered (i.e., lit) when this occurs. Also, the LEDs 9 are lit (i.e., emitting light). The trigger LED' 2 and the LEDs 9 are disabled again when the voltage of the capacitor 7 becomes less than the breakdown voltage thereof. A flashing effect is thus occurred since the above charging and discharging occur sequentially in a short period of time and repeats as long as the light string is activated. Note that the provision of the IC in the trigger LED 2' can enhance the flashing performance of the light string.

Figure 8:
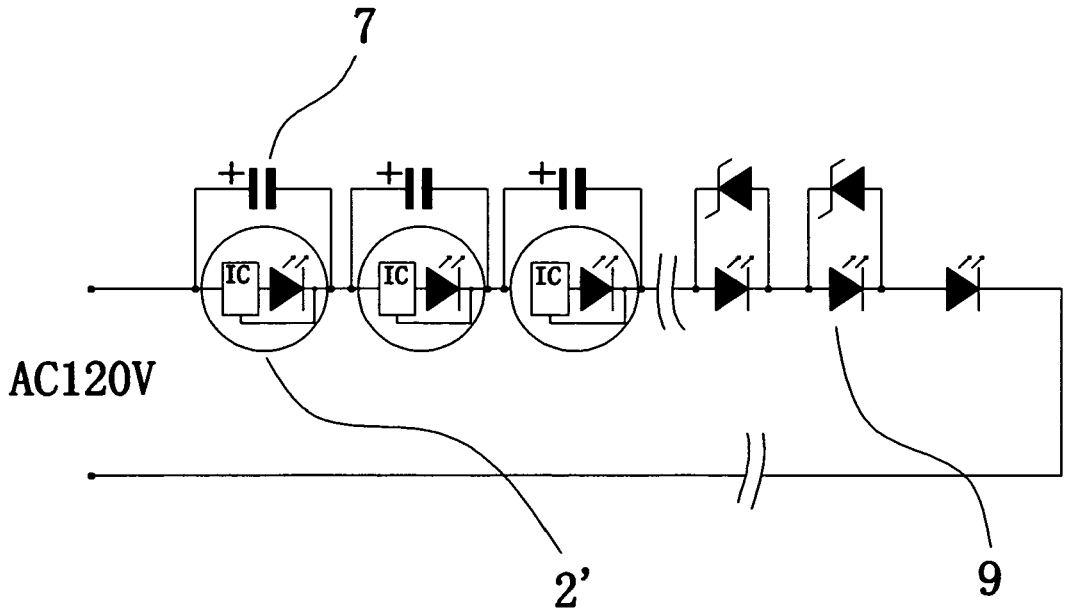

Referring to FIG. 8, a circuit diagram of a fifth preferred embodiment of flashing light string according to the invention is shown. The characteristics of the fifth preferred embodiment (i.e., the trigger LED assembly and the lamps) are detailed below. The lamps are comprised of at least one lamp having an LED 9 and a plurality of lamps having an LED and a Zener diode (not numbered) being connected in parallel with the LED 9. For each set the anode of the LED 9 is connected to the cathode of the Zener diode and the cathode of the LED 9 is connected to the anode of the Zener diode respectively.

The trigger LED assembly comprises a plurality of flashing trigger LEDs 2' having a capacitor 7 connected in parallel therewith (i.e., the voltage of the capacitor 7 is the same as that of the trigger LED 2' of the same set). The trigger LED 2' is comprised of a first LED and a series connected IC in which a first terminal of the IC is connected to the positive terminal of the capacitor 7, a second terminal thereof is connected to the anode of the first LED, and a third terminal thereof is connected to both the cathode of the first LED and the negative terminal of the capacitor 7. The operating voltage and operating current of the flashing trigger LED 2' is 3 VDC and 0.02 A respectively. The flashing trigger LED 2' is adapted to emit light rays of three different colors by flashing. The operating voltage and operating current of the LED 9 is 3 VDC and 0.02 A respectively. The number of the trigger LEDs 2' is 10. The number of the LEDs 9 is 30. The number of the LEDs 9 with a parallel Zener diode is 29.

In operation, for each set of flashing trigger LED 2' the capacitor 7 stores electrical energy initially, i.e., the trigger LED 2' and the LEDs 9 are disabled. The capacitor 7 may discharge when a breakdown voltage thereof is built. The trigger LED 2' is thus triggered (i.e., lit) when this occurs. Also, the LEDs 9 are lit (i.e., emitting light). The trigger LED' 2 and the LEDs 9 are disabled again when the voltage of the capacitor 7 becomes less than the breakdown voltage thereof. A flashing effect is thus occurred since the above charging and discharging occur sequentially in a short period of time and repeats as long as the light string is activated. Note that the provision of the IC in the trigger LED 2' can enhance the flashing performance of the light string. Also, the provision of the Zener diode aims at stabilizing the voltage of the LED 9 of each lamp.

Figure 9:
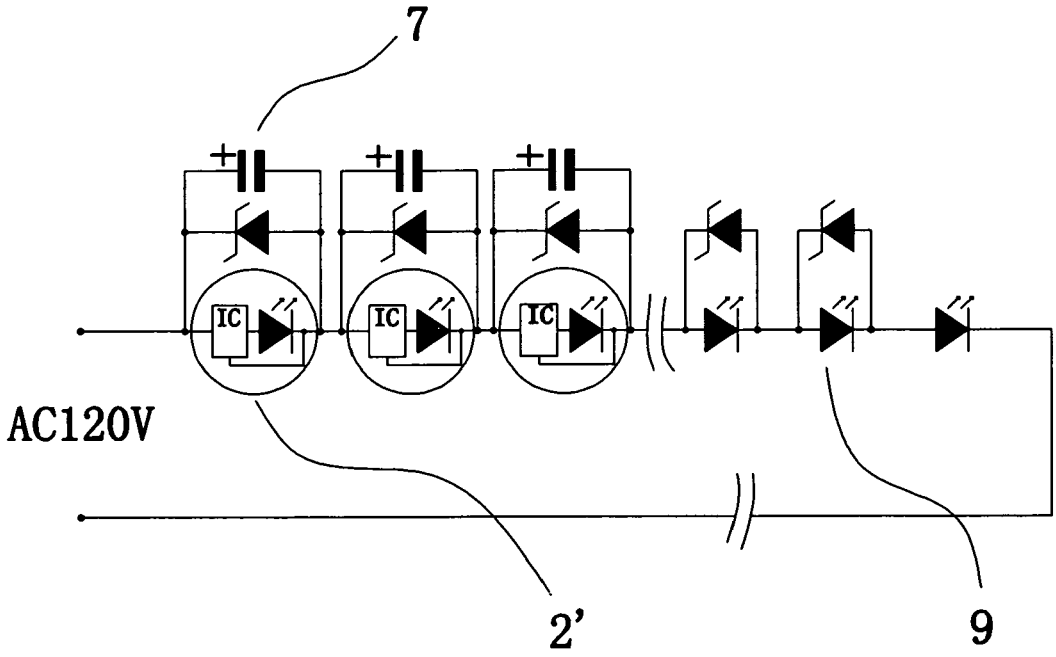

Referring to FIG. 9, a circuit diagram of a sixth preferred embodiment of flashing light string according to the invention is shown. The characteristics of the sixth preferred embodiment (i.e., the trigger LED assembly and the lamp) are detailed below. The lamps are comprised of least one lamp having an LED 9 and a plurality of lamps having an LED 9 and a Zener diode (not numbered) being connected in parallel with the LED 9. For each set the anode of the LED 9 is connected to the cathode of the Zener diode and the cathode of the LED 9 is connected to the anode of the Zener diode respectively.

The trigger LED assembly comprises a plurality of flashing trigger LEDs 2' having a capacitor 7 connected in parallel with the trigger LED 2' and a Zener diode (not numbered) also connected in parallel with the trigger LED 2' (i.e., the voltage of the capacitor 7 is the same as that of each of the trigger LED 2' and the Zener diode). The trigger LED 2' is comprised of a first LED and a series connected IC in which a first terminal of the IC is connected to both the positive terminal of the capacitor 7 and the cathode of the Zener diode, a second terminal thereof is connected to the anode of the first LED, and a third terminal thereof is connected to the cathode of the first LED, the anode of the Zener diode, and the negative terminal of the capacitor 7 respectively.

The operating voltage and operating current of the flashing trigger LED 2' is 3 VDC and 0.02 A respectively. The flashing trigger LED 2' is adapted to emit light rays of two different colors by flashing. The number of the trigger LEDs 2' is 15. Also, the operating voltage and operating current of the LED 9 is 3 VDC and 0.02 A respectively. The number of the LEDs 9 is 25. The number of the LEDs 9 with a parallel Zener diode is 24.

In operation, for each set of flashing trigger LED 2' the capacitor 7 stores electrical energy initially, i.e., the trigger LED 2' and the LEDs 9 are disabled. The capacitor 7 may discharge when a breakdown voltage thereof is built. The trigger LED 2' is thus triggered (i.e., lit) when this occurs. Also, the LEDs 9 are lit (i.e., emitting light). The trigger LED' 2 and the LEDs 9 are disabled again when the voltage of the capacitor 7 becomes less than the breakdown voltage thereof. A flashing effect is thus occurred since the above charging and discharging occur sequentially in a short period of time and repeats as long as the light string is activated. Note that the provision of the IC in the trigger LED 2' can enhance the flashing performance of the light string. Also, the provision of the Zener diode aims at stabilizing the voltage of the LED 9 of each lamp and the voltages of both the IC and the first LED of each trigger LED 2' respectively.

Figure 10:
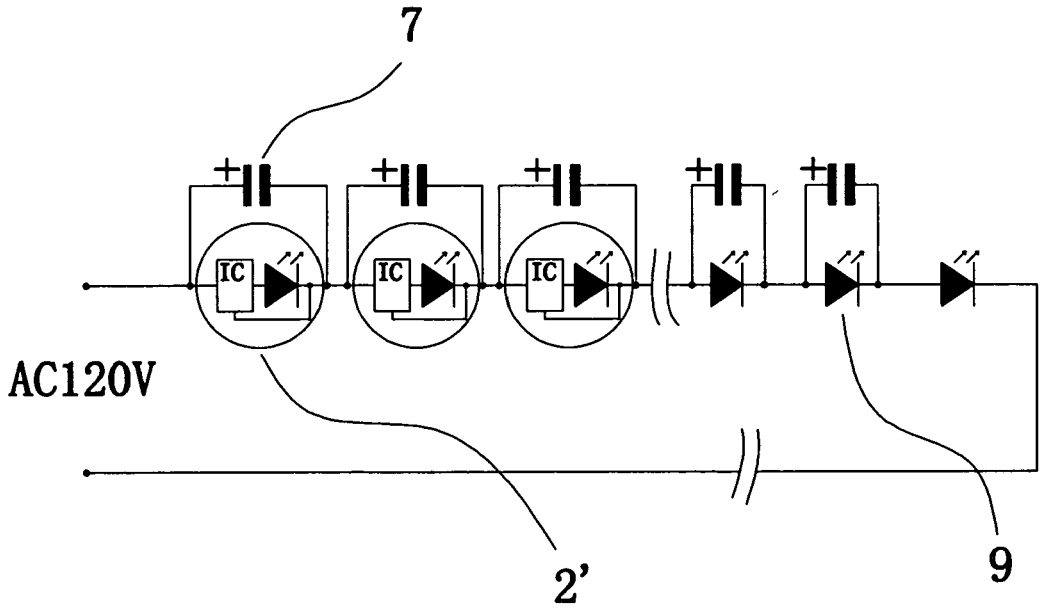

Referring to FIG. 10, a circuit diagram of a seventh preferred embodiment of flashing light string according to the invention is shown. The characteristics of the seventh preferred embodiment (i.e., the trigger LED assembly and the lamps) are detailed below. The lamps are comprised of least one lamp having an LED 9 and a plurality of lamps having an LED 9 and a capacitor (not numbered) being connected in parallel with the LED 9 thereof. For each set the anode of the LED 9 is connected to the positive terminal of the capacitor and the cathode of the LED 9 is connected to the negative terminal of the capacitor respectively.

The trigger LED assembly comprises a plurality of flashing trigger LEDs 2' having a capacitor 7 connected in parallel therewith (i.e., the voltage of the capacitor 7 is the same as that of the trigger LED 2' of the same set). The trigger LED 2' is comprised of a first LED and a series connected IC in which a first terminal of the IC is connected to the positive terminal of the capacitor 7, a second terminal thereof is connected to the anode of the first LED, and a third terminal thereof is connected to both the cathode of the first LED and the negative terminal of the capacitor 7. The operating voltage and operating current of the flashing trigger LED 2' is 3 VDC and 0.02 A respectively. The flashing trigger LED 2' is adapted to emit light rays of two different colors by flashing. The operating voltage and operating current of the LED 9 is 3 VDC and 0.02 A respectively. The number of the trigger LEDs 2' is 5. The number of the LEDs 9 is 35. The number of the LEDs 9 with a parallel capacitor is 34.

In operation, for each set of flashing trigger LED 2' the capacitor 7 stores electrical energy initially, i.e., the trigger LED 2' and the LEDs 9 are disabled. The capacitor 7 may discharge when a breakdown voltage thereof is built. The trigger LED 2' is thus triggered (i.e., lit) when this occurs. Also, the LEDs 9 are lit (i.e., emitting light). The trigger LED' 2 and the LEDs 9 are disabled again when the voltage of the capacitor 7 becomes less than the breakdown voltage thereof. A flashing effect is thus occurred since the above charging and discharging occur sequentially in a short period of time and repeats as long as the light string is activated. Note that the provision of the IC in the trigger LED 2' can enhance the flashing performance of the light string.

While the invention herein disclosed has been described by means of specific embodiments, numerous modifications and variations could be made thereto by those skilled in the art without departing from the scope and spirit of the invention set forth in the claims.

What is claimed is:

1. An electrical circuit for use as a string of lights, comprising:

a load comprising a trigger LED assembly and a lighting assembly connected in series with the trigger LED assembly, the lighting assembly comprising a plurality of series connected lamps comprising an LED; and a rectifier for converting a source of AC (alternating current) into DC (direct current) which is supplied to the load, wherein the trigger LED assembly is adapted to flash and cause the lamps to flash.

2. The electrical circuit of claim 1, wherein the trigger LED assembly comprises a trigger LED and a capacitor connected in parallel with the trigger LED, wherein the trigger LED comprises a first LED and a second LED, and wherein the cathode of the first LED is connected to the cathode of the second LED, the anode of the first LED is connected to the positive terminal of the capacitor, and the anode of the second LED is connected to the negative terminal of the capacitor respectively.

3. The electrical circuit of claim 1, wherein the trigger LED assembly comprises a trigger section including a trigger and an LED member connected in series with the trigger, and a capacitor connected in parallel with the trigger section, and wherein a first terminal of the trigger is connected to the positive terminal of the capacitor, a second terminal thereof is connected to the anode of the LED member, and a third terminal thereof is connected to both the cathode of the LED member and the negative terminal of the capacitor.

4. The electrical circuit of claim 1, wherein the trigger LED assembly comprises a trigger section including a trigger and an LED member connected in series with the trigger, a capacitor connected in parallel with the trigger section, and a Zener diode connected in parallel with the trigger section, and wherein a first terminal of the trigger is connected to both the positive terminal of the capacitor and the cathode of the Zener diode, a second terminal thereof is connected to the anode of the LED member, and a third terminal thereof is connected to the cathode of the LED member, the anode of the Zener diode, and the negative terminal of the capacitor respectively.

5. The electrical circuit of claim 1, wherein the trigger LED assembly comprises a plurality of series connected trigger sections including a trigger and an LED member connected in series with the trigger, and a capacitor connected in parallel with the trigger section, and wherein a first terminal of the trigger is connected to the positive terminal of the capacitor, a second terminal thereof is connected to the anode of the LED member, and a third terminal thereof is connected to both the cathode of the LED member and the negative terminal of the capacitor respectively.

6. The electrical circuit of claim 1, wherein the trigger LED assembly comprises a plurality of series connected trigger sections including a trigger and an LED member connected in series with the trigger, and a capacitor connected in parallel with the trigger section, wherein a first terminal of the trigger is connected to the positive terminal of the capacitor, a second terminal thereof is connected to the anode of the LED member, and a third terminal thereof is connected to both the cathode of the LED member and the negative terminal of the capacitor respectively, wherein each of at least one of the lamps further comprises a Zener diode connected in parallel with the LED thereof, and wherein the anode of the LED is connected to the cathode of the Zener diode and the cathode of the LED is connected to the anode of the Zener diode respectively.

7. The electrical circuit of claim 1, wherein the trigger LED assembly comprises a plurality of series connected trigger sections including a trigger and an LED member connected in series with the trigger, a first Zener diode connected in parallel with the trigger section, and a capacitor connected in parallel with the trigger section, wherein a first terminal of the trigger is connected to both the positive terminal of the capacitor and the cathode of the first Zener diode, a second terminal thereof is connected to the anode of the LED member, and a third terminal thereof is connected to the cathode of the LED member, the anode of the first Zener diode, and the negative terminal of the capacitor respectively, wherein each of at least one of the lamps further comprises a second Zener diode connected in parallel with the LED thereof, and wherein the anode of the LED is connected to the cathode of the second Zener diode and the cathode of the LED is connected to the anode of the second Zener diode respectively.

8. The electrical circuit of claim 1, wherein the trigger LED assembly comprises a plurality of series connected trigger sections including a trigger and an LED member connected in series with the trigger, and a first capacitor connected in parallel with the trigger section, wherein a first terminal of the trigger is connected to the positive terminal of the first capacitor, a second terminal thereof is connected to the anode of the LED member, and a third terminal thereof is connected to both the cathode of the LED member and the negative terminal of the first capacitor respectively, wherein each of at least one of the lamps further comprises a second capacitor connected in parallel with the LED thereof, and wherein the anode of the LED is connected to the positive terminal of the second capacitor and the cathode of the LED is connected to the negative terminal of the second capacitor respectively.

* * * * *